US005420596A

United States Patent [19]

Burrell et al.

[11] Patent Number: 5,420,596

[45] Date of Patent: May 30, 1995

[54] QUARTER-WAVE GAP-COUPLED TUNABLE STRIP ANTENNA

[75] Inventors: Dennis Burrell, Boynton Beach; Kazimierz Siwiak, Coral Springs, both of Fla.

[73] Assignee: Motorola, Inc., Schaumburg, Ill.

[21] Appl. No.: 157,250

[22] Filed: Nov. 26, 1993

[51] Int. Cl.[6] ..... H01Q 1/38

[52] U.S. Cl. ..... 343/700 MS; 343/848

[58] Field of Search ..... 343/700 MS, 702, 829, 343/830, 831, 846, 848; H01Q 1/38

[56] References Cited

U.S. PATENT DOCUMENTS

| | | | |
|---|---|---|---|
| 4,700,194 | 10/1987 | Ogawa et al. | 343/700 MS |
| 4,814,776 | 5/1989 | Caci et al. | 343/702 |
| 4,849,765 | 7/1989 | Marko . | |
| 4,862,181 | 8/1989 | Ponce de Leon et al. | 343/702 |
| 4,933,680 | 6/1990 | Shapiro et al. | 343/700 MS |
| 5,008,681 | 4/1991 | Gavallaro et al. | 343/700 MS |
| 5,075,691 | 12/1991 | Garay et al. | 343/700 MS |
| 5,113,196 | 5/1992 | Ponce de Leon et al. | 343/702 |
| 5,220,335 | 6/1993 | Huang | 343/700 MS |
| 5,241,321 | 8/1993 | Tsao | 343/700 MS |
| 5,245,745 | 9/1993 | Jensen et al. | 343/700 MS |

*Primary Examiner*—Donald Hajec
*Assistant Examiner*—Hoanganh Le
*Attorney, Agent, or Firm*—D. Andrew Floam

[57] ABSTRACT

An antenna has a quarter wave resonant strip (10) and first and second parasitically excited strips (12 and 14) resonant at a lower and upper frequency, respectively, of the antenna bandwidth. The strips (10, 12 and 14) have trim tabs (20, 22 and 24) for adjusting the resonant frequency of each strip. The location of a feed (30) is set to provide a desired impedance match for use by a radio (60) such as a pager. A ground plane (40) provides a grounding for the strips (10, 12 and 14) and inhibits undesirable radio frequency interaction between the radio (60) and the strips (10, 12 and 14).

17 Claims, 3 Drawing Sheets

QUARTER-WAVE GAP-COUPLED TUNABLE STRIP ANTENNA

FIELD OF THE INVENTION

This invention relates generally to antennas for receiving and transmitting UHF radio frequency signals ranging between 800 MHz and 3,000 MHz, and more particularly to such antennas for use in miniature portable devices.

BACKGROUND OF THE INVENTION

With the advent of new paging systems operating in the radio frequency range between substantially 800 MHz and 3,000 MHz, a new problem arises in designing a miniature antenna having the bandwidth necessary for such systems. Conventional pager antennas have a bandwidth limited to about 1% of the receive frequency. This does not provide for frequency hopping in the 902 to 928 MHz band. Furthermore, a single conventional loop antennas cannot both transmit in the 901 to 902 MHz band while receiving in the 929 to 932 or 940 to 941 MHz paging channels as is necessary for new ack-back paging systems.

Thus, what is needed is an antenna for use in a miniature paging device which has a wider bandwidth.

BRIEF DESCRIPTION OF THE INVENTION

In accord with the invention, a miniature radio device has an antenna which comprises a driven resonant strip and a parasitically excited strip.

DESCRIPTION OF THE PREFERRED EMBODIMENT

Figure 1:
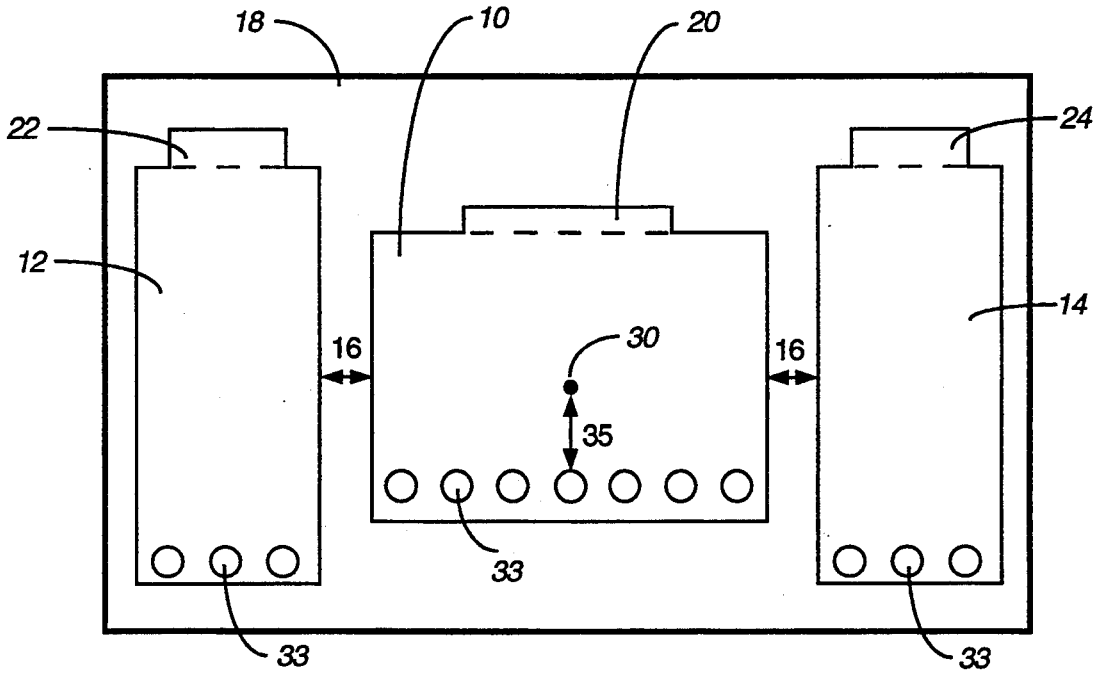
FIG. 1 shows a top view of an antenna in accordance with the preferred embodiment of the invention.

FIG. 1 shows a top view of an antenna in accordance with the preferred embodiment of the invention. The antenna comprises a driven resonant strip, 10, a first parasitically excited strip, 12, and a second parasitically excited strip 14. Parasitically excited strips, 12 and 14, are separated from the resonant strip, 10, by a predetermined distance 16. The strips 10, 12 and 14 are affixed to a first surface of a low loss dielectric substrate 18.

FIG. 1 also shows three trim tabs, 20, 22 and 24, for adjusting a resonant frequency of each strip of the antenna, wherein a first of the three trim tabs, 20, is attached the resonant strip, 10, a second of said three trim tabs, 22, is attached to the first parasitically excited strip, 12, and a third of the three trim tabs, 24, is attached to the second parasitically excited strip, 14. A feed, 30, is coupled at a first end to the resonant strip, 10, and is for coupling the antenna to an electronic radio frequency device such as an ack-back pager. An ack-back pager is capable of receive and transmit functions and has both receiver and transmitter circuits. A multiplicity of ground posts, 33, electrically ground one end of the strips, 10, 12 and 14. The feed, 30 is, located a predetermined distance, 35, from its nearest ground post, 33. In the preferred embodiment seven ground posts, 33, are attached to the resonant strip, 10, three of ground posts, 33, are attached to the first parasitically excited strip, 12, and three ground posts, 33, are attached to the second parasitically excited strip, 14. In an alternate embodiment, only one ground post 33 per strip may be used.

Figure 2:
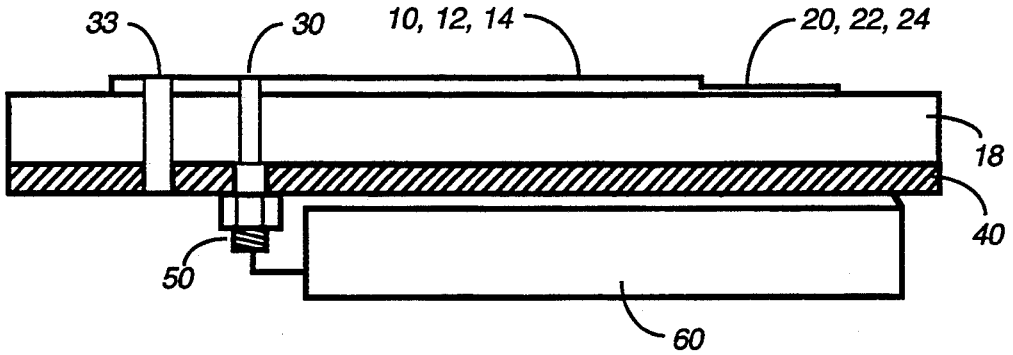
FIG. 2 shows a side view of the antenna in accordance with the preferred embodiment of the invention.

FIG. 2 shows a side view of the antenna in accordance with the preferred embodiment of the invention. A ground plane, 40, is affixed to the second side of the substrate, 18. At a second end of the feed, 30, is attached a RF connector, 50, for interfacing the antenna with a radio receiver circuit such as a receive only selective call receiver paging circuit or an ack-back transceiving paging circuit, 60. The circuit, 60, may be affixed to the ground plane, 40. The ground plane, 40, being substantially parallel and in close proximity to the strips, provides both a ground reference for the antenna strips 10, 12 and 14, and a radio frequency shield to prevent undesirable interference between the antenna and the circuit 60. The second end of each ground post, 33, is attached to the ground plane, 40.

In the preferred embodiment, the substrate, 18, has a length of substantially 84.8 mm, a width of substantially 55.9 mm and a thickness of substantially 3.2 mm and consists of a dielectric material such as FR4 (a flame retardant classification) or other glass/epoxy material. The resonator strip, 10, has a length of substantially 35.6 mm, a width of substantially 45.0 mm, with the trim tab, 20, having a length of substantially 1.3 mm, a width of substantially 7.6 mm. The first parasitically excited strip, 12, has a length of substantially 40.8 mm, and a width of substantially 12.7 mm, with the respective trim tab, 22, having a length of substantially 1.3 mm, and a width of substantially 7.6 mm. The second parasitically excited strip, 14, has a length of substantially 39.5 mm, and a width of substantially 12.7 mm, with the respective trim tab, 24, having a length of substantially 1.3 mm, and a width of substantially 7.6 mm. The strips, 10, 12 and 14, and the trim tabs, 20, 22 and 24 consisting substantially of copper. The strips, 10, 12 and 14, are centered about a common axis relative to each other. The distance, 16, between the strips is substantially 0.10 mm. The distance, 35, between the feed and its nearest ground post is substantially 17.8 mm. The ground posts are located substantially 2.4 mm from an edge of a strip and have a diameter of substantially 2.3 mm. The feed, 30, and resonator strip, 10, are centered about a common axis perpendicular to the ground posts, 33.

Figure 3:
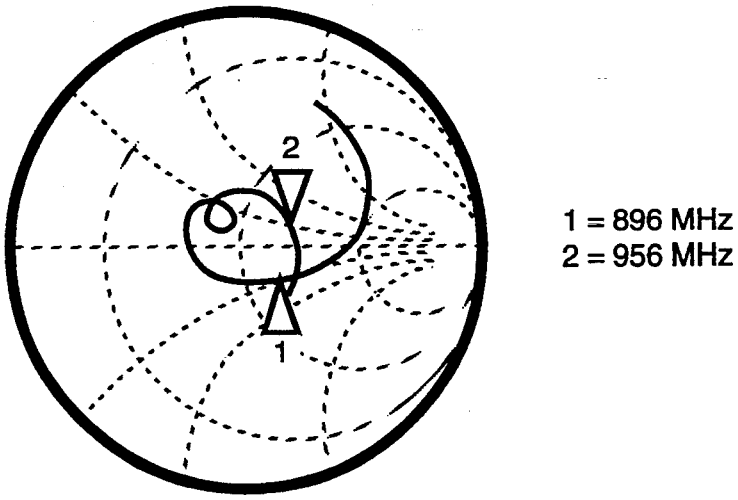
FIG. 3 shows a Smith chart representation of the input impedance resulting from experimental characterization of the antenna of the preferred embodiment.

FIG. 3 shows a Smith chart representation of the input impedance resulting from experimental characterization of the antenna of the preferred embodiment. The Smith chart shows that the reflection coefficient does not exceed 0.33 over the frequency range between substantially 896 MHz and 956 MHz.

Figure 4:
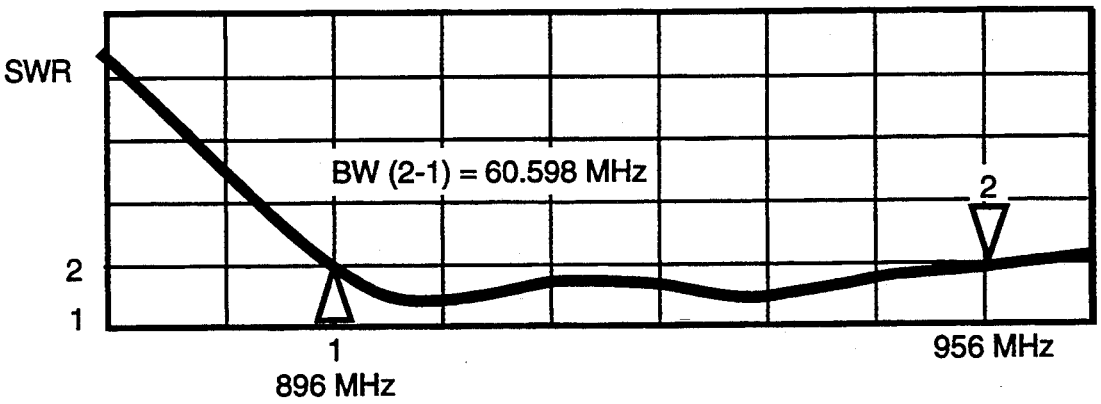
FIG. 4 shows a plot of the standing wave ratio (SWR) resulting from experimental characterization of the antenna of the preferred embodiment.

FIG. 4 shows a plot of the standing voltage wave ratio (SWR) resulting from experimental characterization of the antenna of the preferred embodiment. FIG. 4 shows that between 896 MHz and 956 MHz, the SWR is below 2:1. Thus, the useful bandwidth of the antenna is more than 60 MHz, or about 6.5% of the center frequency of operation.

Furthermore, the overall dimensions of the antenna, 84.8 mm×55.9 mm×substantially 3.2 mm, make the antenna suitable for a miniature paging receiver implemented in a common credit card sized form factor.

In the preferred embodiment, the driven resonant strip, 10, has a quarter-wave resonant length at the center frequency of operation, which is preferably 916 MHz. The distance, 35, between the feed, 30, and its nearest ground post, 33, is set to provide a match to a nominally fifty ohm impedance with a standing wave ratio of 2:1 or less across the operating band. The two parasitically excited strips, 12 and 14, have quarter wave resonant lengths at the upper and lower frequencies of operation, which are preferably 901 and 930 MHz. The distances between the strips, 16, are set to cause capacitive coupling between the strips thereby producing the desired impedance bandwidth of the antenna. The trim tabs, 20, 22 and 24, allow the resonant frequency of each strip, 10, 12 and 14, to be individually adjusted by removing metalization from the respective strip.

Thus, the antenna provides for constructing a miniature pager useful in new paging systems operating in the radio frequency range between substantially 800 MHz and 3000 MHz. The antenna has a bandwidth of about 6.5% of the receive frequency. This provides for frequency hopping in the 902 to 928 MHz band, and the antenna can both transmit in the 901 to 902 MHz band and receive in the 929 to 932 or 940 to 941 MHz paging channels. In alternate embodiments, the dimensions of the antenna of FIG. 1 may be scaled in proportion to provide operation at other frequencies, including the frequencies in the 800 MHz to 3,000 MHz range.

Thus, what is provided is an antenna for use in a miniature paging device which has a bandwidth which is wider than the bandwidth provided by conventional miniature antenna structures.

Figure 5:
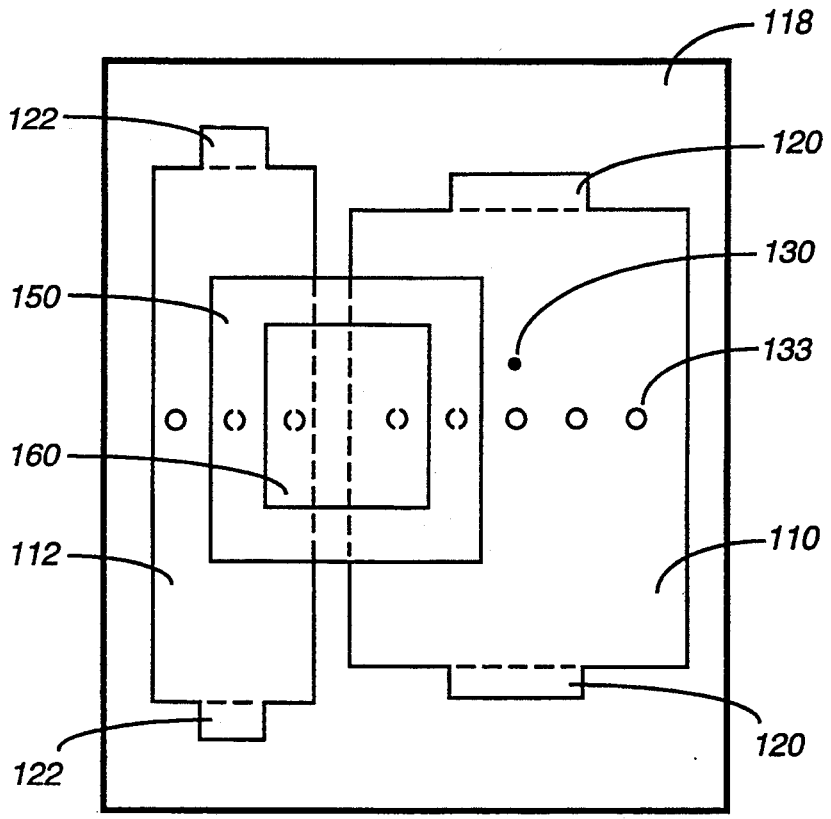
FIG. 5 shows a top view of an alternate embodiment of the present invention.
Figure 6:
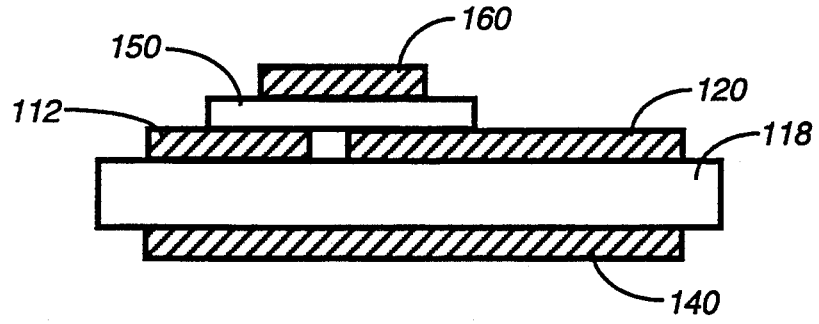
FIG. 6 shows a cross sectional view of the alternate embodiment of FIG. 5.

FIG. 5 shows a top view of an alternate embodiment of the present invention. FIG. 6 shows a cross sectional view of the embodiment of FIG. 5. There is one driven resonant strip, 110, and one parasitically excited resonant strip, 112, each having trim tabs 120 and 122. In this embodiment, the bandwidth is determined by the resonant frequency of the two strips 110 and 112. Since ground posts 133 are in the middle of each strip, the strips are half wave resonant rather than quarter wave resonant as shown in the antenna of FIG. 1. Feed 130 is placed similar to the method of placing feed 30 to obtain a desired impedance match to the antenna. Substrate 118 and ground plane 140 perform similar functions to 18 and 40 respectively. Also, a paging receiver or transceiver circuit may be attached to ground plane 140. It should be appreciated that similar half wave resonant lengths could be implemented with strips 10, 12, and 14 of FIG. 1.

Insulator substrate 150 and plate 160 form an alternate means for coupling strip 110 to strip 120. In stead of relying only on the separation 16 between the strips of FIG. 1, where the coupling is primarily due to fringe fields coupling between the strips, since a portion of plate 160 is overlapping and parallel to strip 110 and another portion of plate 160 is overlapping and parallel to strip 120, plate 160 directly couples strip 120 to strip 110. This results in a substantially improved electrical coupling mechanism between the strips. It should be appreciated that similar coupling could be implemented between strips 10, 12, and 14 of FIG. 1.

We claim:

1. An antenna for use in a miniature radio device capable of receiving signals in a first frequency band, transmitting signals in a second frequency band, the antenna comprising:

a substrate having a first planar surface and a second planar surface;

a ground plane affixed to the second planar surface of the substrate;

a driven resonant strip affixed to the first planar surface of the substrate;

at least a first parasitic strip affixed to the first planar surface and spaced a predetermined distance from the driven resonant strip;

grounding means for electrically coupling the first parasitic strip and the driven resonant strip to said ground plane.

2. The antenna according to claim 1 further comprising:

a second parasitic strip affixed to the first planar surface and spaced from the driven resonant strip by said predetermined distance.

3. The antenna according to claim 2, and further comprising:

a plurality of trim tabs for adjusting a resonant frequency of the antenna, wherein a first of said plurality trim tabs is attached to said driven resonant strip, and a second of said plurality of trim tabs is attached to said first and second parasitic strips.

4. The antenna of claim 2, wherein the first and second parasitic strips have quarter wave resonant lengths at upper and lower frequencies of operation of the antenna.

5. The antenna according to claim 1 wherein said driven resonant strip and said first parasitic strip are quarter wave resonant.

6. The antenna according to claim 1 wherein said driven resonant strip and said first parasitic strip are half wave resonant.

7. The antenna according to claim 1 wherein said driven resonant strip is substantially rectangular and has a first side, said first parasitically resonant strip being spaced from the first side by said predetermined distance.

8. The antenna according to claim 7 further comprising:

a plate for coupling said driven resonant strip to said first parasitic strip, said plate overlapping and parallel to both said driven resonant strip and said first parasitic strip; and an insulator substrate interposed between said plate and said driven resonant strip and said first parasitic strip.

9. The antenna according to claim 1, wherein said grounding means comprises a multiplicity of ground posts attached between said ground plane and said driven resonant strip, and between said ground plane and said first parasitic strip.

10. The antenna according to claim 9 wherein seven of said multiplicity of ground posts are attached to said driven resonant strip, and three of said multiplicity of ground posts are attached to said first parasitic strip.

11. The antenna according to claim 1 further comprising a feed coupled at a first end to said driven resonant strip and having a second end for coupling to a radio receiver circuit affixed to said ground plane.

12. The miniature radio device comprising the antenna according to claim 1 further comprising:

a radio receiver circuit coupled to the antenna for receiving radio frequency signals received by the antenna.

13. The device according to claim 12 wherein said radio receiver circuit is a selective call receiver.

14. The device according to claim 12 further comprising:

a radio transmitter circuit coupled to the antenna for transmitting radio frequency signals through the antenna.

15. The antenna of claim 2, wherein the bandwidth of the antenna is approximately 6.5% of a center frequency of operation of the antenna.

16. The antenna of claim 15, wherein the center frequency of operation of the antenna is approximately 916 Mhz.

17. The antenna of claim 1, wherein the bandwidth of the antenna is approximately 60 MHz.

* * * * *